US006867402B1

(12) United States Patent
Schulte

(10) Patent No.: US 6,867,402 B1
(45) Date of Patent: Mar. 15, 2005

(54) SYSTEM FOR SENSING THE PRESENCE OF A LOAD IN AN OVEN CAVITY OF A MICROWAVE COOKING APPLIANCE

(75) Inventor: Robert A. Schulte, Williamsburg, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/819,915

(22) Filed: Apr. 8, 2004

(51) Int. Cl.[7] ..... H06B 6/68
(52) U.S. Cl. ..... 219/704; 219/720
(58) Field of Search ..... 219/702, 704, 219/706, 716, 720

(56) References Cited

U.S. PATENT DOCUMENTS

| | | | | |
|---|---|---|---|---|
| 3,281,567 | A | | 10/1966 | Meissner et al. |
| 3,412,227 | A | | 11/1968 | Anderson |
| 3,467,804 | A | * | 9/1969 | Smith ..... 219/706 |
| 3,662,140 | A | | 5/1972 | Jones et al. |
| RE29,837 | E | | 11/1978 | Moore |
| 4,126,777 | A | | 11/1978 | Moore |
| 4,341,937 | A | | 7/1982 | Staats |
| 4,363,957 | A | | 12/1982 | Tachikawa et al. |
| 4,367,388 | A | | 1/1983 | Ishihara et al. |
| 4,831,239 | A | | 5/1989 | Ueda |
| 4,868,357 | A | * | 9/1989 | Serikawa et al. ..... 219/706 |
| 5,171,947 | A | | 12/1992 | Kusunoki et al. |
| 5,237,141 | A | | 8/1993 | Yoshino et al. |
| 5,293,019 | A | * | 3/1994 | Lee ..... 219/708 |
| 5,550,355 | A | | 8/1996 | Jung |
| 5,695,672 | A | | 12/1997 | Kim |
| 5,793,025 | A | | 8/1998 | Niimi et al. |
| 5,828,042 | A | | 10/1998 | Choi et al. |
| 6,166,362 | A | | 12/2000 | Shon et al. |
| 6,172,348 | B1 | | 1/2001 | Yoshino et al. |
| 6,348,680 | B2 | | 2/2002 | Kim et al. |
| 6,396,035 | B2 | | 5/2002 | Shon et al. |
| 6,452,141 | B1 | | 9/2002 | Shon |
| 6,472,650 | B1 | | 10/2002 | Kim et al. |
| 2001/0020617 | A1 | | 9/2001 | Kim et al. |

FOREIGN PATENT DOCUMENTS

| | | | |
|---|---|---|---|
| EP | 0 622 973 | A1 * | 11/1994 |
| JP | 63150525 | | 6/1988 |
| JP | 63223423 | | 9/1988 |
| JP | 2002372244 | | 12/2002 |

* cited by examiner

*Primary Examiner*—Teresa J. Walberg
(74) *Attorney, Agent, or Firm*—Diederiks & Whitelaw, PLC

(57) ABSTRACT

A microwave cooking appliance includes an oven cavity, a magnetron and a load sensing system. The load sensing system is used to detects the presence of a load in the oven cavity by introducing a high frequency energy burst into the oven cavity, with the energy burst being reflected back. A controller, based on a time period between emitted and reflected signals, determines whether a load is present in the oven cavity. If no load is present, operation of the magnetron is terminated. Preferably, the high frequency energy burst is an ultrasonic acoustic frequency energy burst in a range between approximately 10 kHz and 100 kHz.

20 Claims, 1 Drawing Sheet

SYSTEM FOR SENSING THE PRESENCE OF A LOAD IN AN OVEN CAVITY OF A MICROWAVE COOKING APPLIANCE

BACKGROUND OF THE INVENTION

1. Field of the Invention

The present invention pertains to the art of cooking appliances and, more particularly, to a microwave cooking appliance including a system for sensing the presence of a load in an oven cavity of the cooking appliance.

2. Discussion of the Prior Art

Cooking appliances utilizing a directed microwave energy field to cook a food item have existed for some time. In general, a cooking process is performed operating a microwave emitter, such as a magnetron, to direct standing microwave energy fields into an oven cavity such that the microwave energy fields reflect about the oven cavity and impinge upon the food item. As the microwave energy fields impinge upon the food item, the energy fields are converted into heat through two mechanisms. The first mechanism, ionic heating, results from the liner acceleration of ions, generally in the form of salts, present within the food item. The second mechanism is the molecular excitation of polar molecules, primarily water, present within the food item. Regardless of the particular mechanism, the nature of the standing waves results in localized areas of high and low energy which cause the food to cook unevenly. This is especially true in larger ovens where the size of the cavity requires a more uniform energy distribution in order to properly cook the food. To attain an even or uniform energy distribution, the microwave energy must be introduced into the oven cavity in a manner which creates a constructive standing wave front which will propagate about the oven cavity in a random fashion.

Another area of concern in microwave cooking is microwave energy fields being directed into an empty or substantially empty oven cavity. Without the presence of a load, the microwave energy fields could damage interior portions of the oven cavity. In addition, the microwave energy fields could reflect back into the magnetron causing damage to internal structure of the magnetron. In recognition of this problem, the prior art has proposed several solutions. For example, U.S. Pat. No. 5,550,355 discloses a microwave oven having a load sensing system. The oven includes a control that measures oven cavity temperature. If, based on the oven cavity temperature, the control determines that there is no load in the oven cavity, the oven is shut down. In another arrangement, disclosed in U.S. Pat. No. 3,412,227, a neon tube is mounted within a microwave oven. In the event that no load is present, reflective energy in the oven will become substantial enough to illuminate the neon tube. In turn, the neon tube activates a photocell that, upon sensing light from the neon tube, signals a control to discontinue operation of the oven. While each of the above devices is effective, the overall response time is slow, allowing significant energy to still be directed into an empty oven cavity. Over time, the cumulative effects of running the oven with no load could lead to damage to both the oven cavity and the magnetron.

Based on the above, there still exists a need for an effective load sensing device in a microwave oven. More specifically, there exists a need for a load sensing device in a microwave oven that has a short response time so that, in the event that the microwave oven is operated without a load in the oven cavity, operation of the microwave oven will be immediately terminated.

SUMMARY OF THE INVENTION

The present invention is directed to a microwave cooking appliance including an oven cavity defined by a plurality of walls, a magnetron adapted to selectively emit a microwave energy field into the oven cavity and a load sensing system. More specifically, the load sensing system includes a controller and a transducer that emits a high frequency energy burst into the oven cavity. The high frequency energy burst is reflected back to the transducer which then sends a signal to the controller. Based upon the nature of the signal, the controller will determine whether or not a load is present in the oven cavity. If no load is sensed, the controller will terminate operation of the appliance.

In accordance with the most preferred form of the invention, the load sensing system is constituted by a piezoelectric transducer that emits an ultrasonic high frequency energy burst into the oven cavity. Once emitted, the ultrasonic high frequency energy burst is reflected back from one of the load or oven cavity walls to the piezoelectric transducer. The transducer converts the reflected energy burst into an electronic signal that is forwarded to the controller. The controller then determines a time differential between the emitted burst and the reflected burst. Actually, the reflected signal would exhibit a cavity signature including a magnitude of energy at a particular frequency and a time delay. Based thereon, the controller can determine whether or not there is a load present in the oven cavity.

In accordance with a preferred form of the invention, the controller includes a memory unit having stored therein a predetermined time value corresponding to an empty oven. The time value is equivalent to the time required for the ultrasonic high frequency burst to travel across at least part of the oven cavity and back again. Thus, a load in the oven cavity would cause an energy burst to return to the transducer in a time less than the stored, predetermined value.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
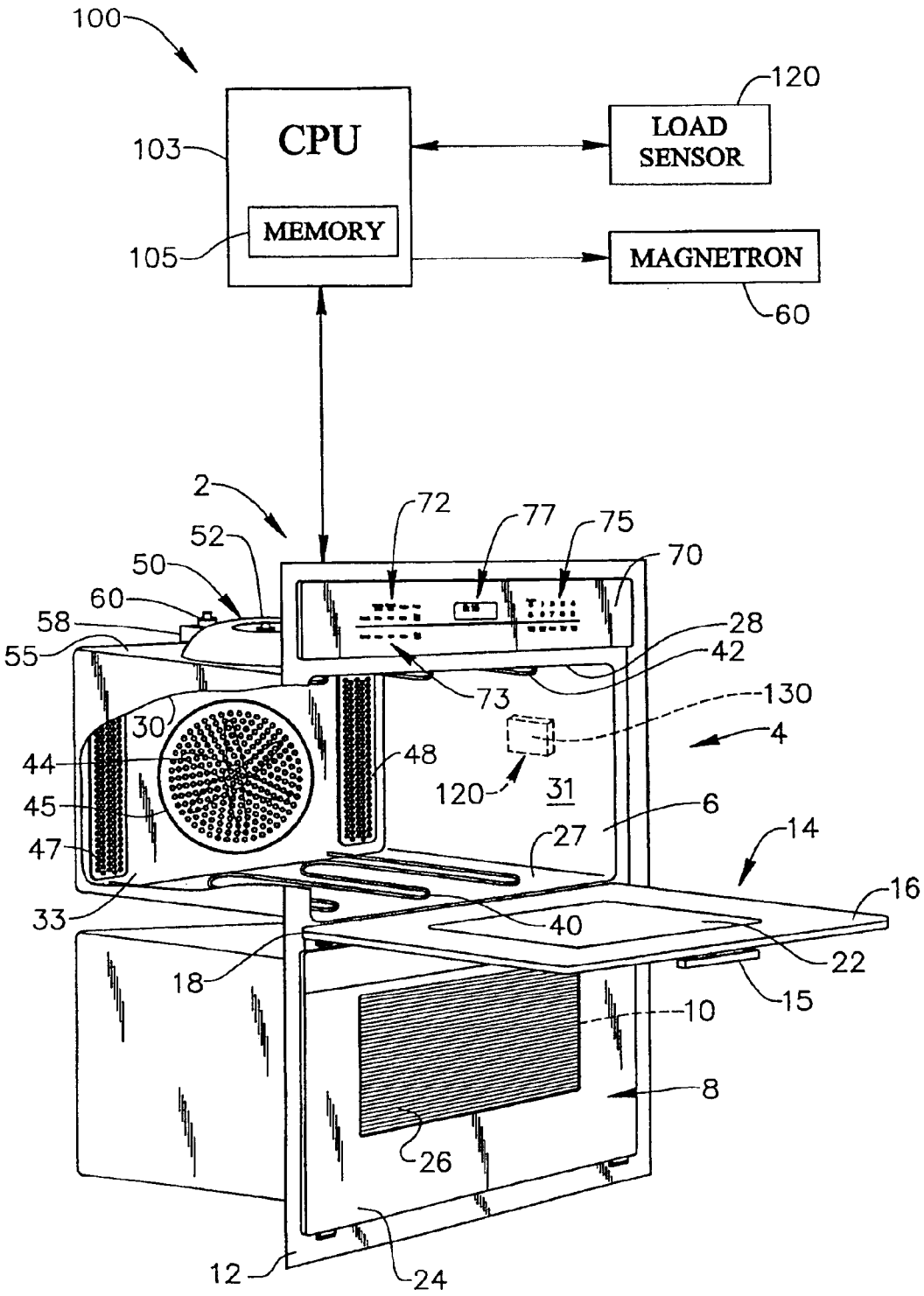
FIG. 1 is an upper left, partial perspective view of a microwave cooking appliance including a load sensing system constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention is not limited to this model type and may be incorporated into various other types of oven configurations, e.g., cabinet mounted ovens, slide-in and free standing ranges, as well as conventional countertop models. In any event, in the embodiment shown, cooking appliance 2 constitutes a dual oven wall unit including an upper oven 4 having an upper oven cavity 6 and a lower oven 8 having a corresponding lower oven cavity 10. In further accordance with the embodiment shown, cooking appliance 2 includes an outer frame 12 for, at least partially, supporting both upper and lower oven cavities 6 and 10 within a wall or other appropriate structure.

In a manner known in the art, cooking appliance 2 includes a door assembly 14 adapted to selectively provide access to upper oven cavity 6. Door assembly 14 includes a handle 15 positioned at an upper portion 16 thereof. In the embodiment shown, door assembly 14 is adapted to pivot relative to outer frame 12 at a lower portion 18. In a manner also known in the art, door 14 is provided with a transparent zone or window 22 for viewing the contents of oven cavity 6 when door assembly 14 is closed. In addition, door assembly 14 is provided with a choke assembly (not shown) that prevents microwave energy from escaping out of oven cavity 6 during a microwave cooking operation. A corresponding door assembly 24 including a transparent zone or window 26 is provided to selectively access lower oven cavity 10.

Oven cavity 6 is defined by a bottom wall 27, an upper wall 28, opposing side walls 30 and 31, and a rear wall 33. In the preferred embodiment shown, bottom wall 27 is constituted by a flat, smooth surface designed to improve the overall cleanability and reflectivity of oven cavity 6. Arranged about bottom wall 27 of oven cavity 6 is a bake element 40. Also, a top broiler element 42 is arranged adjacent to upper wall 28. Top broiler element 42 is provided to enable a consumer to perform a grilling process in upper oven 4, as well as to aid in pyrolytic heating during a self-clean operation. In any event, both bake element 40 and top broiler element 42 are constituted by sheathed, electric resistive heating elements in a form commonly used for cooking applications.

Cooking appliance 2 actually constitutes an electric, dual wall oven. However, it is to be understood that cooking appliance 2 could equally operate on gas, either natural or propane. In any case, oven cavities 6 and 10 preferably employ both radiant and convection heating techniques for the preparation of food items therein. To this end, rear wall 33 is shown to include a convection fan or blower 44. Although the exact position and construction of fan 44 can readily vary in accordance with the invention, in the embodiment shown, fan 44 draws in air at a central intake zone 45 and directs the air into oven cavity 6 through a pair of outlet vents 47 and 48 so as to provide a recirculating air flow within oven cavity 6. In addition to radiant and convection heating techniques, cooking appliance 2 includes a microwave cooking system 50. As shown, microwave cooking system 50 includes a wave guide 52 mounted to an exterior upper surface 55 of oven cavity 6. Wave guide 52 includes a launching zone 58 having mounted thereto a magnetron 60. In accordance with the embodiment shown, magnetron 60 is adapted to emit an RF or microwave energy field at a frequency of approximately 2.45 GHz. However, it should be understood that magnetron 60 could be adapted to deliver any RF energy field employed in microwave cooking.

As further shown in FIG. 1, cooking appliance 2 includes an upper control panel 70 having a plurality of control elements. In accordance with one embodiment, the control elements are constituted by first and second sets of oven control buttons 72 and 73, as well as a numeric pad 75. Control panel 70 is adapted to be used to input desired cooking parameters to establish a preferred cooking operation, e.g., baking, broiling or microwave cooking, as well as to establish a pyrolytic cleaning operation. More specifically, first and second sets of control buttons 72 and 73, in combination with numeric pad 75 and a display 77, enable a user to establish particular cooking operations for upper and lower ovens 4 and 8 respectively.

In general, the structure described above is provided for the sake of completeness and to set forth exemplary cooking appliance structure in order to enable a better understanding of the present invention which is particularly directed to a load sensing system 100 adapted to sense a presence of a load within oven cavity 6 during a microwave cooking operation. In accordance with a preferred embodiment of the present invention, load sensing system 100 includes a controller 103 having a memory 105 that is linked to a load sensor 120 and, as will be discussed more fully below, to magnetron 60. Load sensor 120 is adapted to emit a high frequency energy burst into oven cavity 6. Once emitted, the high frequency energy burst reflects off of an opposing wall of oven cavity 6, or a load in oven cavity 6, back to load sensor 120. At this point, load sensor 120 converts the reflected energy burst into an electric signal that is sent to controller 103. More specifically, in accordance with a preferred embodiment of the invention, the signal represents a time lapse or $\Delta t$ between the emitted high frequency energy burst and the received high frequency energy burst. Controller 103 then determines whether or not, based on the time lapse, a load is present within oven cavity 6.

In the most preferred form of the invention, load sensor 120 is constituted by a piezoelectric transducer 130 that converts electric energy into acoustic energy and acoustic energy into electric energy of the same frequency. In accordance with the invention, piezoelectric transducer 130 is formed from quartz, barium titanate, lithium sulfate, lead metaniobate or lead zirconate titanate. However, other compounds having similar properties are also acceptable. In any event, piezoelectric transducer 130 in the most preferred form of the invention is adapted to emit a high frequency, acoustic energy burst into oven cavity 6. Preferably, the high frequency, acoustic energy burst is in a range of between approximately 10 kHz and approximately 100 kHz. As discussed above, piezoelectric transducer 130 emits the ultrasonic high frequency acoustic energy burst into oven cavity 6. The energy burst travels through oven cavity 6 at a known velocity. Specifically, the energy burst travels at the speed of sound. The ultrasonic high frequency acoustic energy burst reflects off of either a load present within oven cavity 6 or an opposing wall. The reflected energy burst is subsequently received by piezoelectric transducer 130 which then converts the acoustic energy signal into an electronic signal that is forwarded to controller 103.

Stored within memory 105 of controller 103 is a base line time differential or $\Delta t_b$ corresponding to an empty oven cavity. That is, for example, in a 12 inch (30.5 cm) wide cavity, the reflection time would be approximately 1.839 ms. Therefore, if the signal forwarded to controller 103 from load sensor 120 is substantially equal to $\Delta t_b$, controller 103 sets a no load condition. If it is determined that a no load condition exists within oven cavity 6, controller 103 interrupts operation of magnetron 60 so as to prevent the propagation of microwave energy waves into the empty oven cavity 6. In the event that the actual time differential or $\Delta t_{act}$ is less than the base line time differential $\Delta_{tb}$, controller 103 determines the existence of a load condition within oven cavity 6 and continues to operate magnetron 60 in accordance with the selected cooking operation.

With this arrangement, load sensor 120 is provided to prevent damage to internal surfaces of oven cavity 6 and magnetron 60. That is, high frequency microwave energy waves reflecting in an empty oven cavity will impinge upon internal surfaces of the oven cavity and be absorbed, at least partially, by the internal surfaces. This absorption of the high frequency microwave energy can ultimately cause damage to the internal oven surfaces which could lead to lower cooking efficiencies for cooking appliance 2. In addition, without a load, microwave energy waves could find their way back to magnetron 60. If the microwave energy waves do return to magnetron 60, magnetron 60 may eventually fail or at least the efficiency of cooking appliance 2 will be reduced.

Although described with reference to a preferred embodiment of the present invention, it should be readily apparent to one of ordinary skill in the art that various changes and/or modifications can be made to the invention without departing from the spirit thereof. For instance, while the load sensor is shown mounted on a side wall of the oven cavity, other locations, such as the top or bottom wall are equally acceptable. In fact, different frequencies could be emitted from different locations, either simultaneously or sequentially, to excite the cavity and/or load. In addition, although the cooking appliance as described employs convection, radiant and microwave cooking, one of ordinary skill in the art should understand that the present invention would operate equally as well in an oven employing only microwave cooking techniques. Furthermore, while the load sensor is described as both sending and receiving signals, a transmitter and a separate receiver could be employed. Finally, in addition to acoustic sensing, other high frequency signals could be employed. Again, as indicated above, the reflected signals actually exhibit a cavity signature including a magnitude of energy at a particular frequency, as well as the time delay aspect described above. In accordance with the invention, the magnitude of the energy in the reflected signals could also be employed in determining the presence of a load and controlling the generation of microwave energy. In general, the invention is only intended to be limited by the scope of the following claims.

I claim:

1. A microwave cooking appliance comprising:

an oven cavity having top, bottom, rear and opposing side walls and a frontal opening;

a door pivotally mounted relative to the oven cavity, said door being adapted to selectively close the frontal opening;

a magnetron for introducing a microwave energy field into the oven cavity to perform a cooking operation;

a load sensing system selectively emitting signals into and receiving reflected signals from within the oven cavity; and a controller linked to each of the load sensing system and the magnetron, wherein the controller determines a presence of a load in the oven cavity in as short as a few milliseconds based upon a time lapse between the signals emitted into and received from the load sensing system and, when a no load condition exists, limits operation of the magnetron.

2. The microwave cooking appliance according to claim 1, wherein the load sensing system includes a piezoelectric transducer.

3. The microwave cooking appliance according to claim 2, wherein the piezoelectric transducer is mounted on a side wall of the oven cavity.

4. The microwave oven appliance according to claim 1, wherein the load sensing system includes a single load sensor for both emitting and receiving acoustic signals.

5. The microwave oven appliance according to claim 4, wherein the acoustic signals constitute high frequency energy bursts.

6. The microwave cooking appliance according to claim 5, wherein the high frequency energy bursts constitute ultrasonic energy bursts.

7. The microwave cooking appliance according to claim 6, wherein the ultrasonic energy bursts are in a range between approximately 10 kHz to 100 kHz.

8. The microwave cooking appliance according to claim 1, wherein the controller terminates operation of the cooking appliance when the no load condition exists.

9. The microwave cooking appliance according to claim 1, wherein the cooking appliance is a wall oven.

10. A microwave cooking appliance comprising:

an oven cavity having top, bottom, rear and opposing side walls and a frontal opening;

a door pivotally mounted relative to the oven cavity, said door being adapted to selectively close the frontal opening;

a magnetron for introducing a microwave energy field into the oven cavity to perform a cooking operation;

means for emitting a high frequency signal into the oven cavity;

means for receiving the high frequency signal produced by the emitting means;

means for sensing a presence of a load in the oven cavity in as short as a few milliseconds based on a time lapse between the high frequency signal emitted from the emitting means and received by the receiving means; and a controller linked to the sensing means and the magnetron, said controller receiving a signal from the sensing means reflective of a presence of a load in the oven cavity and, when a no load condition exists, limits operation of the magnetron.

11. The microwave cooking appliance according to claim 10, wherein the emitting means and the receiving means are constituted by a piezoelectric transducer.

12. The microwave cooking appliance according to claim 10, wherein the signal emitted by the emitting means and received by the receiving means is a high frequency acoustic energy burst.

13. The microwave cooking appliance according to claim 12, wherein the high frequency acoustic energy burst is constituted by an ultrasonic high frequency acoustic energy burst.

14. The microwave cooking appliance according to claim 13, wherein the ultrasonic high frequency acoustic energy burst in a range between approximately 10 kHz and 100 Hz.

15. The microwave cooking appliance according to claim 10, wherein the sensing means terminates operation of the cooking appliance when the no load condition exists.

16. The microwave cooking appliance according to claim 10, wherein the emitting means and the receiving means are mounted to a side wall of the oven cavity.

17. The microwave cooking appliance according to claim 16, wherein the emitting means and receiving means are constituted by a single piezoelectric transducer.

18. A method of controlling a cooking operation in an oven cavity of a microwave cooking appliance comprising:

operating a magnetron to deliver a microwave energy field into the oven cavity to initiate a cooking operation;

emitting an acoustic signal into the oven cavity;

receiving a reflection of the acoustic signal emitted into the oven cavity;

determining a presence of a load in the oven cavity in as short as a few milliseconds based upon a time lapse between the emitted signal and the received signal; and limiting operation of the magnetron when no load is present in the oven cavity.

19. The method of claim 18, wherein the acoustic signal is emitted by and the reflection is received by a piezoelectric transducer.

20. The method of claim 18, wherein operation of the magnetron is terminated when no load is present in the oven cavity.

* * * * *